US012207745B2

(12) United States Patent
Volpe-Bonomo

(10) Patent No.: US 12,207,745 B2
(45) Date of Patent: Jan. 28, 2025

(54) DRIVEWAY DEFENDER FOR CONTAINERS

(71) Applicant: Driveway Defender LLC, Stuart, FL (US)

(72) Inventor: Robert J. Volpe-Bonomo, Stuart, FL (US)

( * ) Notice: Subject to any disclaimer, the term of this patent is extended or adjusted under 35 U.S.C. 154(b) by 356 days.

(21) Appl. No.: 17/806,094

(22) Filed: Jun. 9, 2022

(65) Prior Publication Data

US 2022/0400874 A1 Dec. 22, 2022

Related U.S. Application Data

(60) Provisional application No. 63/211,583, filed on Jun. 17, 2021.

(51) Int. Cl.

| | |
|---|---|
| ***A47F 7/00*** | (2006.01) |
| ***A47F 7/28*** | (2006.01) |
| ***B65D 25/28*** | (2006.01) |
| ***B65D 85/20*** | (2006.01) |

(52) U.S. Cl.

CPC ..... *A47F 7/0035* (2013.01); *A47F 7/28* (2013.01); *B65D 25/2811* (2013.01); *B65D 85/20* (2013.01)

(58) Field of Classification Search

CPC ..... A47F 7/0035; A47F 7/28; B65D 25/2811; B65D 85/20

USPC ..... 188/4 R, 32; 280/763.1

See application file for complete search history.

(56) References Cited

U.S. PATENT DOCUMENTS

| | | | | |
|---|---|---|---|---|
| 4,546,996 | A * | 10/1985 | Hanson | E02F 3/964 280/764.1 |
| 4,915,335 | A | 4/1990 | Miles | |
| 5,210,903 | A | 5/1993 | Horning | |
| 9,586,562 | B1 | 3/2017 | Noonan | |
| 10,046,909 | B2 * | 8/2018 | Tullo | B65F 1/141 |
| 10,322,704 | B2 * | 6/2019 | Nobles | E02F 9/085 |
| 10,549,676 | B2 * | 2/2020 | Sauer | B60P 7/0892 |
| 2008/0048427 | A1 * | 2/2008 | Lagsdin | B60S 9/02 280/763.1 |
| 2012/0242051 | A1 | 9/2012 | Lacasse | |
| 2018/0186346 | A1 * | 7/2018 | Tullo | B60S 9/04 |

* cited by examiner

*Primary Examiner* — Christopher P Schwartz

(74) *Attorney, Agent, or Firm* — McNees Wallace & Nurick LLC

(57) ABSTRACT

A container support for engaging and abutting a roller of a container for ground protection. A heptagonal sleeve is connected to a base, the sleeve including a medial section, a pair of angled portions, each angled portion upstanding angularly from the medial section, each angled portion transitioning into a vertical portion, and each vertical portion transitioning into a lip portion, thereby forming a pair of lip portions, wherein each lip portion angles toward a geometric center of the sleeve. As such, the lip portion is adapted to engage and abut a roller of a container. Further included are a pair of handles, each handle connected to the distal section at the base front edge, and each handle connected to the exterior surface of the sleeve. Each handle is generally rectangular and has a slot defined therein to aid in grasping and placement of the container support.

12 Claims, 3 Drawing Sheets

DRIVEWAY DEFENDER FOR CONTAINERS

CROSS-REFERENCE TO RELATED APPLICATIONS

The present application claims benefit of provisional application Ser. No. 63/211,583, filed Jun. 17, 2022, the contents of which are incorporated herein by reference.

BACKGROUND

Field of the Invention

The invention relates to sleeves to be situated underneath the wheels or supports of roll-off containers to protect the ground surface.

Description of the Related Art

When a roll-off container is placed on a surface, damage may occur to the surface, such as scratches, cracks or dents. Traditionally, a hauler will place a piece of wood under the container's rollers to minimize any marks that may result when removing the loaded container. However, this rarely stops the denting or concaving of the asphalt or the cracking of concrete driveways.

U.S. Pat. No. 10,046,909 describes pads for engagement with dumpster supports to spread the weight of the dumpster over a large surface area and provide a relatively soft ground contact interface to prevent damage to paved surfaces on which the dumpster may be placed. The pads define a cavity complementary to the dumpster support and may be affixed to the support by straps or fasteners.

Drawbacks exist in the art as much as the current devices are cumbersome and take up space, rendering their transportation and storage within the confines of the vehicles and such burdensome. Moreover, the durability of such supports are questionable, and when the shapes of the pads deform, the usefulness is impacted. Lastly, because some pads do not attach to the dumpster prior to the placement of the dumpster on the grounds, the roll-off container supports must precisely align with the pads, which is a time-consuming and difficult process, especially with limited personnel.

SUMMARY

Comprehended is a sleeve for placement on the container and resulting surface to receive the roller of the container (even prior to placement) to thereby receive the weight of the container and prevent underlying surface damage.

Accordingly, provided is a container support, comprising: a base; the base having a base front edge, two distal sections and a medial section, each distal section transitioning into a distal end wherein each distal end curves upward. A sleeve is connected to the base, the sleeve being heptagonal to include: a medial section, a pair of angled portions, each angled portion upstanding angularly from the medial section, each angled portion transitioning into a vertical portion, and each vertical portion transitioning into a lip portion, thereby forming a pair of lip portions, wherein each lip portion angles toward a geometric center of the sleeve. As such, the lip portion is adapted to engage and abut a roller of a container. Further included are a pair of handles, each handle connected to the distal section at the base front edge, and each handle connected to the exterior surface of the sleeve. Each handle is generally rectangular and has a slot defined therein to aid in grasping and placement of the container support, as follows.

DETAILED DESCRIPTION OF THE PREFERRED EMBODIMENT

Figure 1:
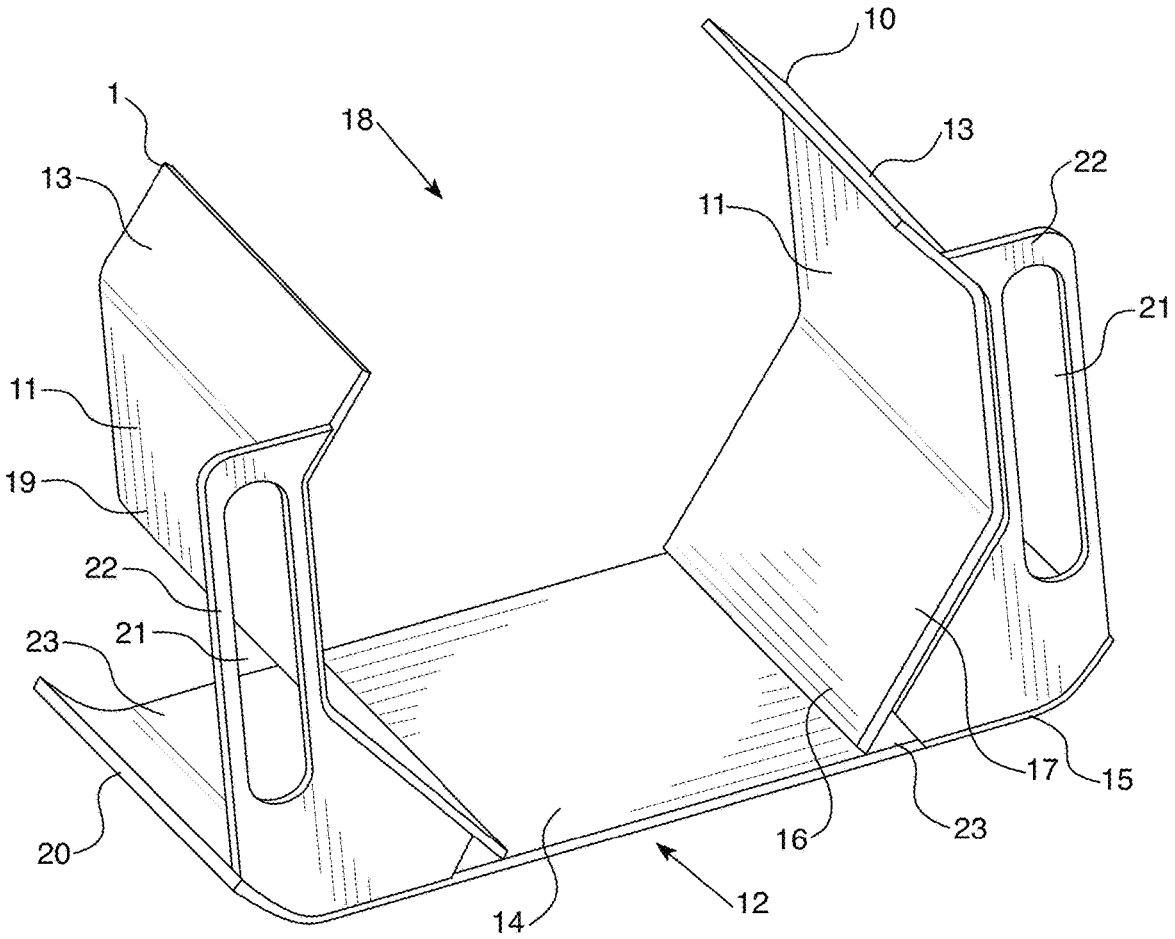
FIG. 1 shows a perspective view of the instant driveway defender.
Figure 2:
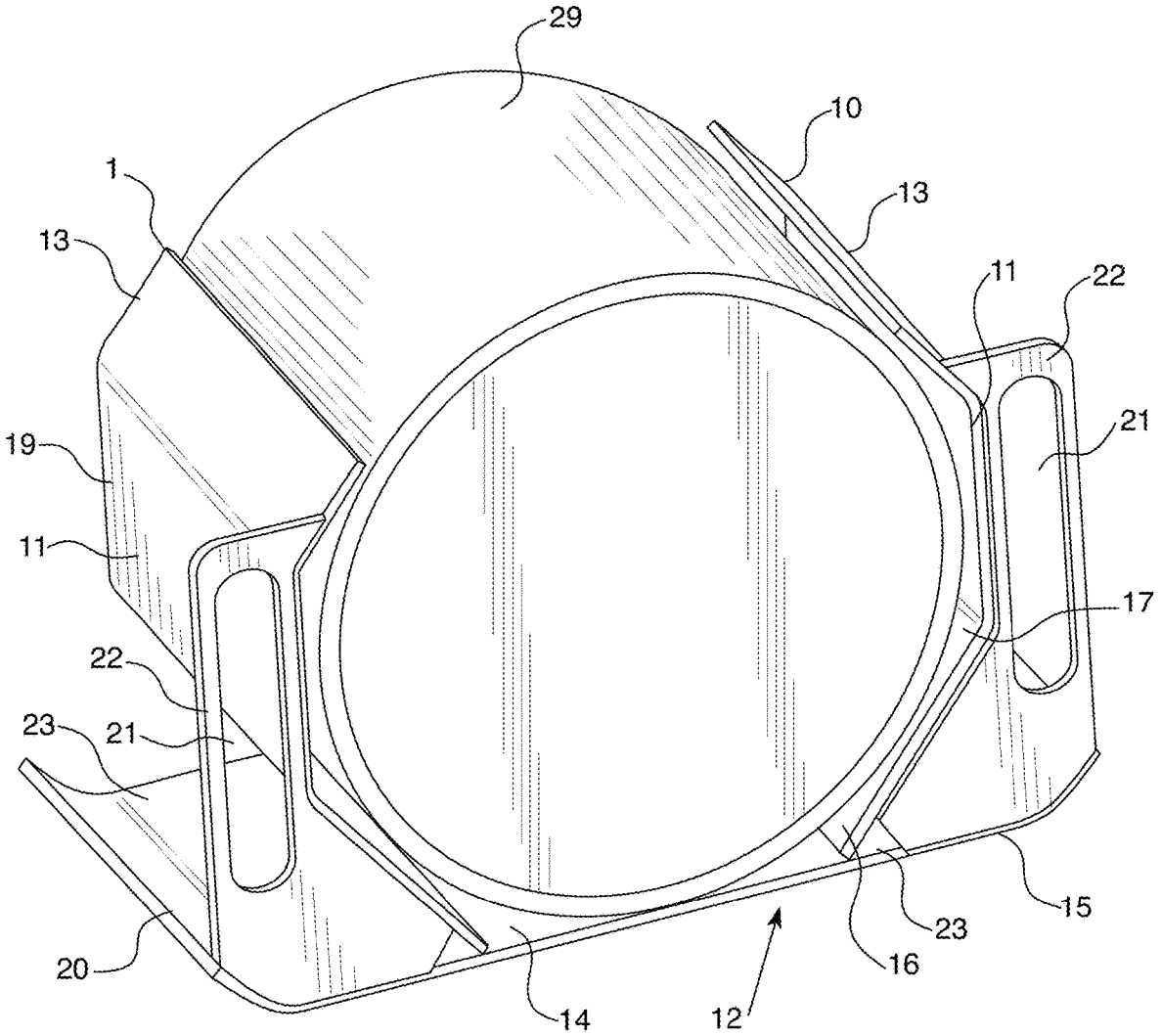
FIG. 2 shows another perspective view of the driveway defender situated on the wheel support of a roll-off container.
Figure 3:
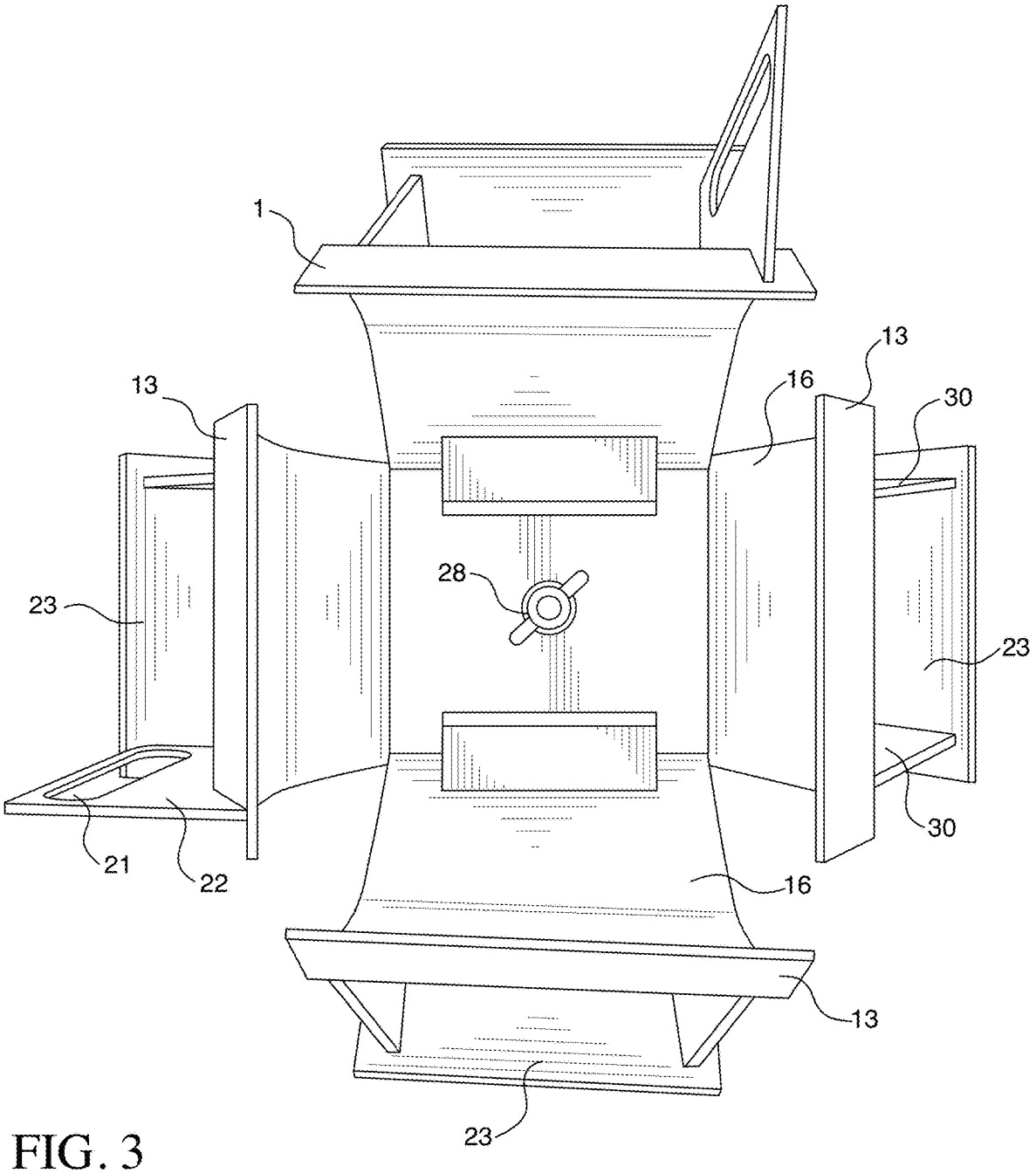
FIG. 3 shows a top elevation view of an alternative embodiment of one-handle driveway defenders stacked and mounted for storage and transport.

Referencing then FIGS. 1-3, shown is the instant driveway defender, also termed herein container support 1. "A" as used in the claims means one or more, so comprehended is a container support 1 comprising a base 12 and a sleeve 10. The sleeve 10 is connected to the base 12 as shown. "Connected" herein means the sleeve is integral or welded to base and part of the base is shared by the sleeve as discussed herein. Both base 12 and sleeve 10, in the exemplified embodiment, and thus the container support 1 in its entirety, is made of a rigid, strong material such as metal, e.g. ⅛" or ¼" steel. The sleeve 10 is generally heptagonal as shown, meaning thus generally U-shaped in cross section albeit not curved. Rather, and as further defining "heptagonal", the sleeve 10 has seven integral plate components which partially encircle a geometric center 18. Each half of the sleeve 10 (and container support 1) mirror each other about the geometric center 18. The sleeve 10 has an exterior surface 19 and interior surface 17 also relative to this geometric center 18. Although not shown, the sleeve's interior surface 17 can be lined with a high density, hard polymer.

Sleeve 10 includes a medial section 14, a pair of angled portions 16, with each angled portion 16 upstanding angularly from the medial section 14. "Angularly" here means not perpendicular, so as to travel over the base 12 at an acute angle then transition into a vertical portion 11 as shown, the vertical portion 11 being generally perpendicular to base 12. Each vertical portion 11 thereafter transitions into a lip portion 13, thereby forming a pair of lip portions 13. Each lip portion 13 is angled toward a geometric center of the sleeve 10. As such, in this heptagonal shape, the sleeve 10 can envelope a roller 29 of a container. More particularly, each lip portion 13 is adapted to engage and abut a roller 29 of a container to the extent the container support 1 can be slid onto the roller 29 and essentially hang thereon as the container is placed, thereby the container support 1 including base 12 can carry the load of the container instead of the ground upon placement, e.g. driveway or roadway.

The base 12 includes a base front edge 15, two distal sections 23 and it shares the medial section 14 of sleeve 10, supra. Each distal section 23 transitions into a distal end 20 wherein each distal end 20 curves upward as shown. Curved distal ends 20 allow the container support 1 to be lifted over uneven ground if a slip or slide occurs during servicing. Further, base 12 can include a central bore 28 (shown partially hidden by FIG. 3, covered by a nut). The central bore 28 being defined therein is adapted to receive a means for hanging the container support 1. Such means for hanging can be a plate, bracket, rod, screw or any type of post or clamp that could be affixed to a truck or the roll-off container itself, thus a second or multiple of container supports 1 can be stacked in alternating fashion, (e.g. ninety-degree increments) and hung for convenient storage and transport (see FIG. 3).

With continued reference to FIGS. 1-3, shown are one or more, preferably a pair of handles 22. Each handle 22 is connected to both the base 12 and sleeve exterior surface 19 as shown, particularly at each of the two distal sections 23 at the base front edge 15 depicted as generally elongate, rectangular tabs. As such, the container support 1 can be easily grasped for placement by a user's hands. To further aid in such, a slot 21 is defined through each handle 22. Handle 22 also adds to the strength of the container support 1. Additionally, and as shown best by FIG. 3, a brace 30 is affixed between base 12 and medial section 14 away (distal from base front edge 15) from handle 22 to further add strength to the container support 1.

Accordingly, in use, the driveway defender container support 1 is designed to minimize or eliminate scratches, cracks or dents in surfaces such as driveways resulting from roll-off waste container placement. The sleeve 10 is located and placed over the container rollers 29 as the container is set. In this manner the base 12 of the sleeve 10 carries the weight of the roll-off container upon placement. The container support 1 also allows the roller 29 to pivot inside of itself. Once the loaded container has been lifted, the container support 1 can be lifted and stored on the storage hanger.

I claim:

1. A container support, comprising:

a base;

a sleeve connected to said base, said sleeve being heptagonal to include: a medial section, a pair of angled portions, each said angled portion upstanding angularly from said medial section away from a geometric center of said sleeve, each said angled portion transitioning into a vertical portion, and each said vertical portion transitioning into a lip portion, thereby forming a pair of lip portions, each said lip portion angled toward said geometric center of said sleeve, wherein each said lip portion is adapted to engage and abut a roller of a container.

2. The container support of claim 1, wherein said base further comprises a base front edge, two distal sections and said medial section, each said distal section transitioning into a distal end wherein each said distal end curves upward.

3. The container support of claim 2, wherein said sleeve has an exterior surface and an interior surface.

4. The container support of claim 3, further comprising a pair of handles, each said handle connected to said distal section and said exterior surface.

5. The container support of claim 4, wherein each said handle is connected to said distal section at said base front edge, and each said handle is connected to said exterior surface of said sleeve, each said handle generally rectangular having defined therein a slot.

6. The container support of claim 2, wherein said base includes a central bore defined therein through said medial section.

7. The container support of claim 1, further comprising a brace affixed between said base and said medial section.

8. A container support, comprising:

a base, said base having a base front edge, two distal sections and a medial section, each said distal section transitioning into a distal end wherein each said distal end curves upward;

a sleeve connected to said base, said sleeve having an exterior surface and an interior surface;

a pair of handles, each said handle connected to each said distal section and said exterior surface.

9. The container support of claim 8, wherein said sleeve is heptagonal to include: said medial section of said base, a pair of angled portions, each said angled portion upstanding angularly from said medial section away from a geometric center of said sleeve, each said angled portion transitioning into a vertical portion, and each said vertical portion transitioning into a lip portion, thereby forming a pair of lip portions, each said lip portion angled toward said geometric center of said sleeve, wherein each said lip portion is adapted to engage and abut a roller of a container.

10. The container support of claim 8, wherein each said handle is connected to each said distal section at a base front edge, and each said handle is connected to said exterior surface of said sleeve, each said handle generally rectangular having defined therein a slot to allow grasping thereof.

11. The container support of claim 8, wherein said base includes a central bore defined therein through said medial section.

12. A container support, comprising:

a base, said base having a base front edge, two distal sections and a medial section;

a sleeve connected to said base, said sleeve having an exterior surface, an interior surface and a vertical portion, said vertical portion perpendicular to said medial section of said base such that base is generally flat in relation to a supporting ground;

a pair of handles, each said handle connected to each of said distal sections at said base front edge, and each said handle connected to said exterior surface of said sleeve, each said handle generally rectangular having defined therein a slot; and, a central bore defined therein through said medial section, wherein said container support can receive and situate a second of said container supports also having said central bore such that each said central bore is aligned and adapted to receive a means for hanging said container support.

* * * * *